US005785023A

United States Patent [19]

Cross

[11] Patent Number: 5,785,023

[45] Date of Patent: Jul. 28, 1998

[54] SUPERCHARGED SUPPLY FUEL CONTROL APPARATUS

[75] Inventor: Earnest C. Cross, Simi Valley, Calif.

[73] Assignee: Paxton Products Inc., Camarillo, Calif.

[21] Appl. No.: 741,548

[22] Filed: Oct. 31, 1996

[51] Int. Cl.[6] ..... F02M 37/04

[52] U.S. Cl. ..... 123/463; 137/510

[58] Field of Search ..... 123/382, 383, 123/463, 506; 137/271, 510

[56] References Cited

U.S. PATENT DOCUMENTS

| | | | |
|---|---|---|---|
| 2,947,320 | 8/1960 | Oxley | 137/271 |
| 3,656,500 | 4/1972 | Mayer | 137/271 |
| 3,722,487 | 3/1973 | Ohama | 123/382 |
| 4,073,313 | 2/1978 | Smallwood | 137/271 |
| 4,350,128 | 9/1982 | Boudy | 123/383 |
| 4,543,935 | 10/1985 | Tuckey | 137/510 |
| 4,625,695 | 12/1986 | Tuckey | 123/463 |
| 4,646,700 | 3/1987 | Tuckey | 137/510 |
| 4,828,218 | 5/1989 | Medlock | 137/505.14 |
| 5,065,725 | 11/1991 | Spoetter | 123/463 |

*Primary Examiner*—Carl S. Miller
*Attorney, Agent, or Firm*—William W. Haefliger

[57] ABSTRACT

A flow control unit for controlling liquid fuel pressure supplied to a supercharged internal combustion engine fuel injector or injectors, comprising housing structure having fuel inlet and outlet ports, and a first chamber through which fuel flows in flowing to and through the ports, and through a valving port in the chamber; the housing structure also defining a second chamber spaced from the first chamber; a diaphragm assembly extending between the chambers and movable relative thereto, the assembly including a first diaphragm having a first side exposed to the first chamber, and a second diaphragm having a first side exposed to the second chamber; structure for communicating engine manifold pressure to the second diaphragm, whereby a decrease in the manifold pressure results in a reduced liquid fuel pressure delivered to the injector or injectors; and a control structure associated with the assembly to allow adjustment of the effective cross sectional area of the second diaphragm.

10 Claims, 4 Drawing Sheets

SUPERCHARGED SUPPLY FUEL CONTROL APPARATUS

BACKGROUND OF THE INVENTION

This invention relates generally to control of liquid fuel pressure supplied to fuel injectors for supercharged internal combustion engines, as for example vehicle engines. More specifically, it concerns controlling the rate of change of fuel pressure supplied to such fuel injectors as the "boost" pressure (air pressure delivered by the supercharger) varies, as for example increases or decreases.

Liquid fuel is commonly supplied under pressure, as from a pump to a fuel rail, i.e., a hollow duct supplying such fuel under pressure to fuel injectors, at the engine. Fuel pressure in the rail should increase as the rate of compressed air delivery by the supercharger increases, and vice versa. Such control of fuel pressure in the rail may be effected by valving in a fuel return line from the rail to a fuel tank; however, the use of a single diaphragm in such valving has led to uneven and generally unsatisfactory variations in rate of change of fuel pressure in the rail, as the boost pressure delivered by the supercharger rapidly changes, as during engine-driven vehicle acceleration and deceleration.

Typical superchargers are of centrifugal type, with impellers rotating at between 25,000 and 52,000 revolutions per minute, and boost pressure can change rapidly. Accordingly, there is need for simple, effective means to overcome such difficulties and problems, and to provide a smoother rate of change of fuel pressure in the rail, as boost pressure changes.

SUMMARY OF THE INVENTION

It is a major object of the invention to provide a solution to such problems, as through improved valving, meeting the above need. Basically, the invention is embodied in an improved flow control unit for controlling liquid fuel pressure supplied to a supercharged internal combustion engine fuel injector or injectors, as in a supply rail referred to above. The unit will be seen to comprise:

a) housing means having fuel inlet and outlet ports, and a first chamber through which fuel flows in flowing to and through the ports, and through a valving port in the chamber, b) the housing means also defining a second chamber spaced from the first chamber, c) a diaphragm assembly extending between the chambers and movable relative thereto, the assembly including a first diaphragm having a first side exposed to the first chamber, and a second diaphragm having a first side exposed to the second chamber, d) means for communicating engine manifold pressure to the second diaphragm, whereby a decrease in the manifold pressure results in a reduced liquid fuel pressure delivered to the injector or injectors, e) and control means associated with the assembly to allow adjustment of the effective cross sectional area of the second diaphragm.

Typically, and as will be seen, the control means comprises a control plate adjacent the second side of the second diaphragm, and associated structure extending peripherally about the plate, allowing plate movement with the second diaphragm along an axis extending through the chambers, the area of the plate being selectable. That plate is selectable as to size, to achieve a desired smooth rate of change of fuel pressure with changes in boost pressure; and it is integrated with the diaphragm assembly, which includes structure extending between the two diaphragms and spacing them apart, while allowing them to move together as a unit.

A valve stopper is carried by the diaphragm assembly and is movable toward and away from the valving port to control return flow of liquid fuel from the rail, through the control unit, to a fuel supply tank.

Yet another object includes provision of a compression spring in the housing, and acting on the diaphragm assembly, to urge that assembly and the valve stopper toward the valving port. A threaded adjustor is rotatable to adjust the spring compression and in relation to the action of the second diaphragm, to control the base level at which rate of change, as referred to, occurs.

These and other objects and advantages of the invention, as well as the details of an illustrative embodiment, will be more fully understood from the following specification and drawings, in which:

DRAWING DESCRIPTION

DETAILED DESCRIPTION

Figure 1:
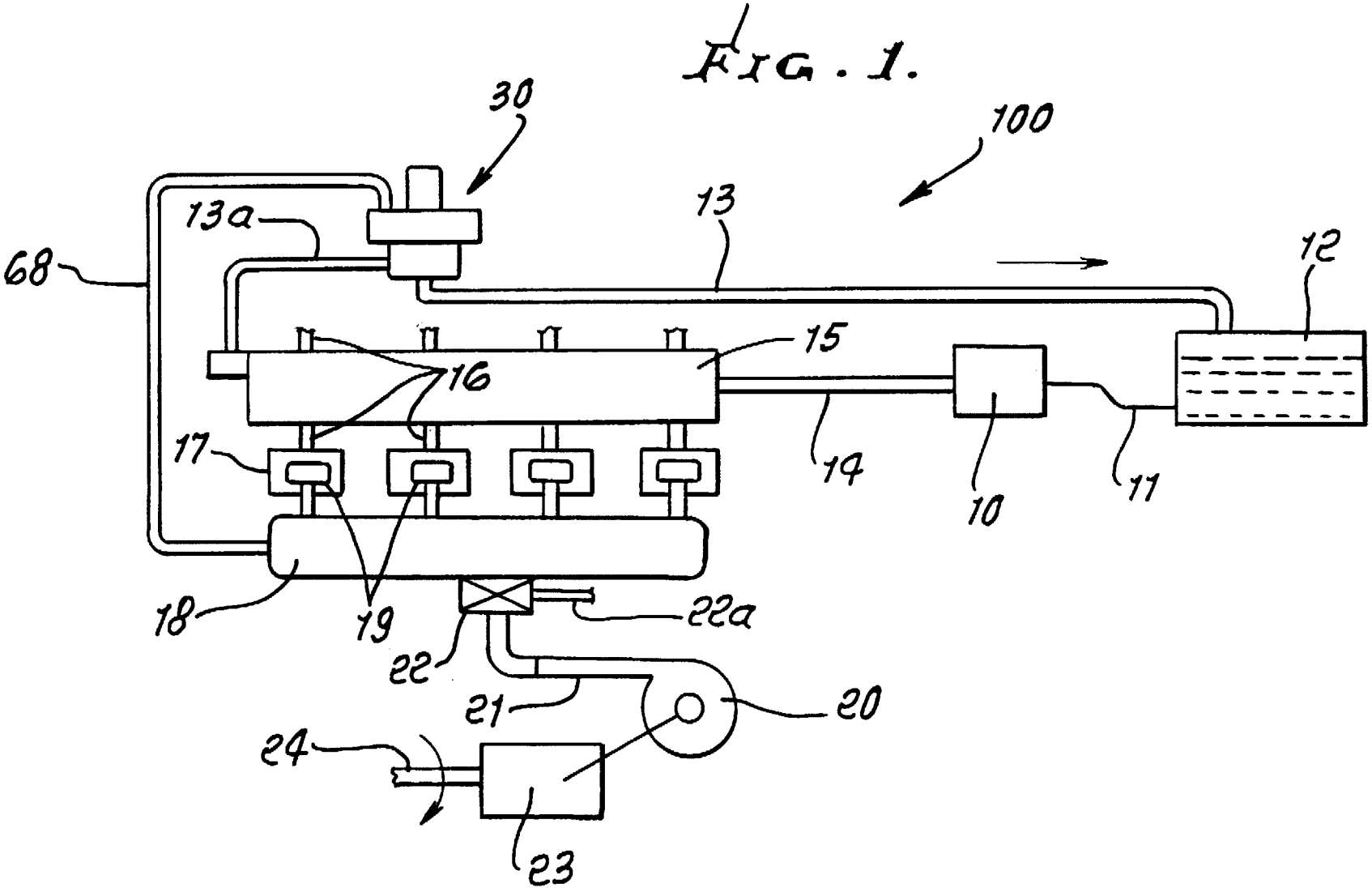
FIG. 1 is a system diagram.

Referring first to FIG. 1, it schematically shows a system 100 that incorporates the improved flow control unit operating in that system. As shown, a liquid fuel (for example gasoline) pump 10 takes suction at 11 from a fuel tank 12, to which excess fuel is returned at 13. The pressurized fuel is delivered via a line 14 to the interior of a rail or elongated tube 15. Fuel injector or injectors 16, operated by means not shown, receive fuel under pressure from the rail, for timed injection into engine cylinders schematically indicated at 17.

The cylinders also receive supercharged, i.e., compressed air, from a manifold 18, as via valves indicated at 19 and operated by suitable means, such as cams. The supercharger 20, typically of centrifugal type, delivers compressed air via duct 21, to the manifold. A butterfly valve 22 in duct 21 is operator controlled, as at **22*a*, to control air delivery to the manifold. The supercharger impeller drive appears at 23; and the engine crankshaft is indicated at 24**.

The flow control unit 30 is connected in series with return line 13, and receives fuel from the rail via return line extension **13*a*. It acts to increase the return flow via lines 13 and 13*a* from the rail, thereby reducing the pressure level in the rail, and thereby reducing the rate of fuel injection to the cylinders, as the rate of air flow to the cylinders is reduced, as for example may result from closing or partial closing of the butterfly valve. Such reduction of air flow to the cylinders corresponds to a reduced air pressure level in the manifold 18**.

Figure 2:
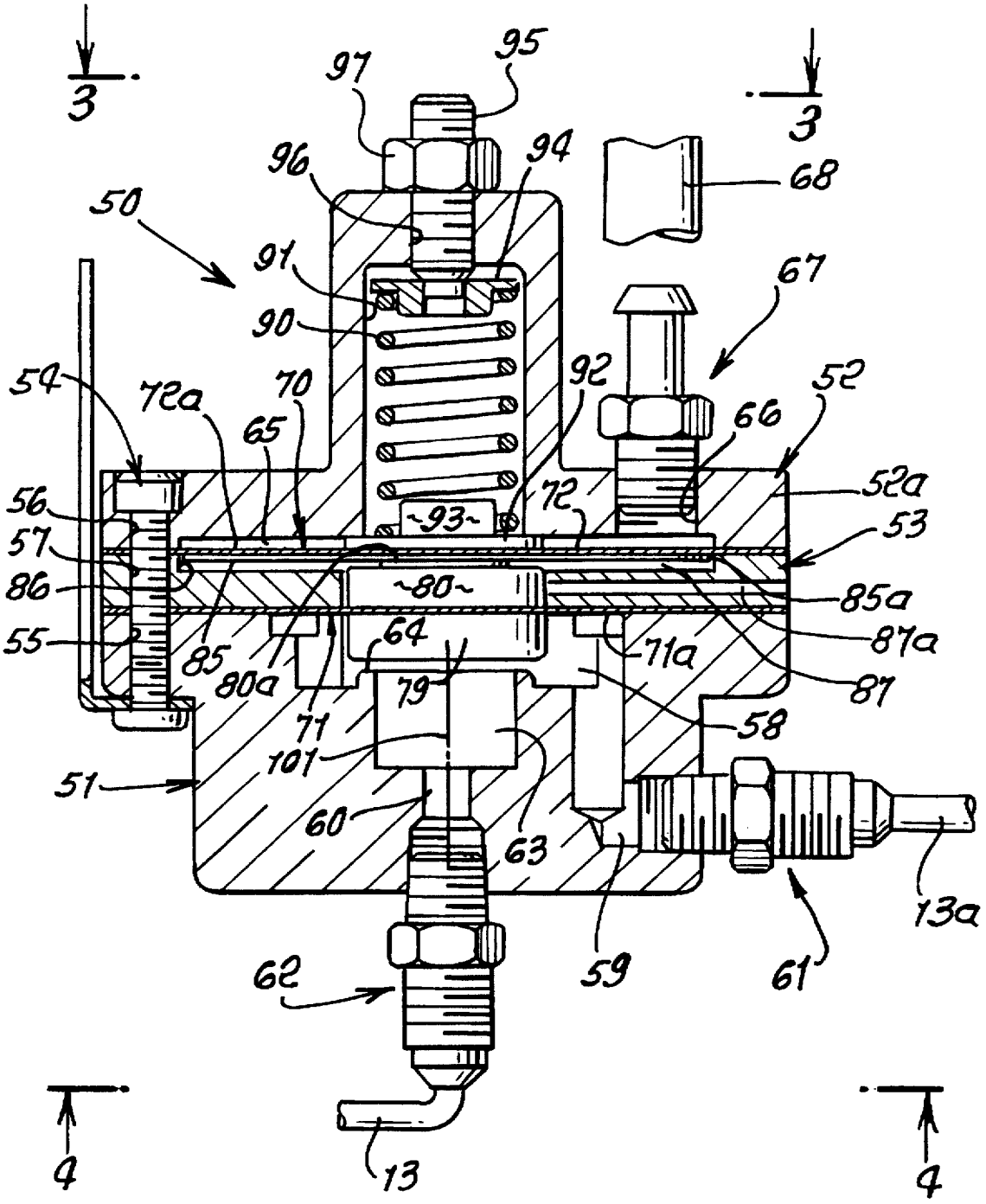
FIG. 2 is an enlarged vertical elevation taken in section through a liquid fuel flow control unit, embodying the invention.
Figure 3:
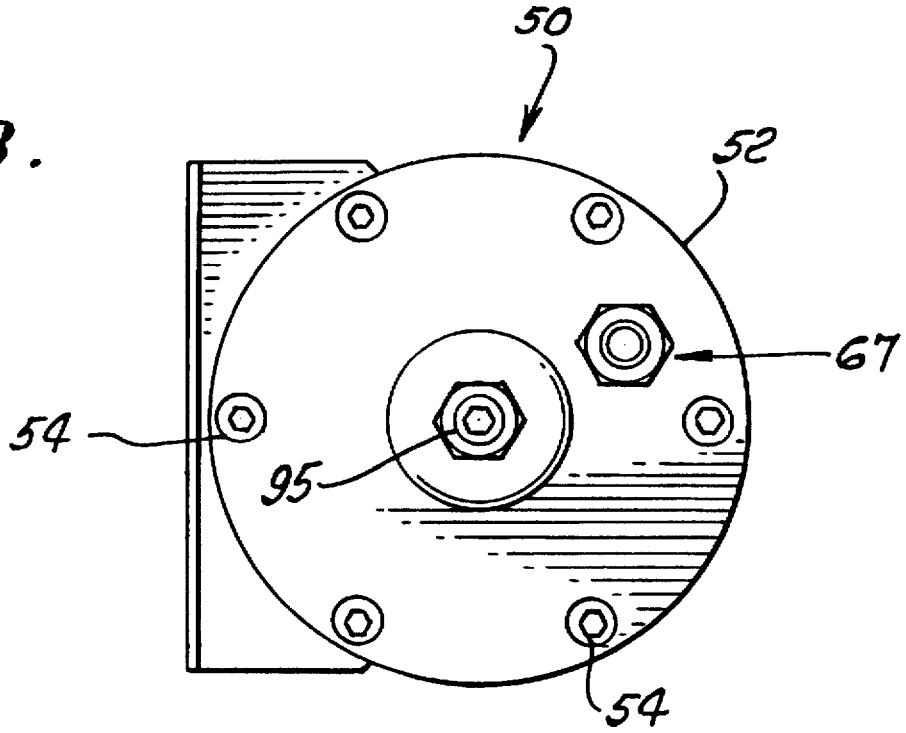
FIG. 3 is a top plan view taken on lines 3—3 of FIG. 2.
Figure 4:
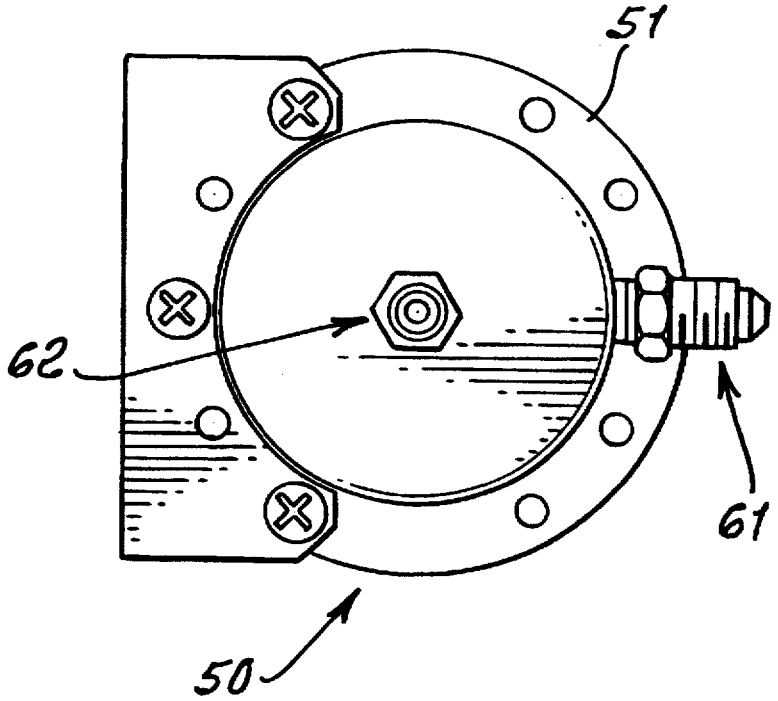
FIG. 4 is a bottom plan view taken on lines 4—4 of FIG. 2.

Turning now to FIG. 2, the flow control unit includes a housing means generally indicated at 50, and which may include a lower body 51, a top cap 52, and an intermediate plate 53. Fasteners 54 extend through or into openings 55, 56, and 57, as indicated, to interconnect these elements 51–53. The lower body 51 forms a first chamber indicated at 58 through which fuel flows in passing through inlet port 59 and outlet port 60. Threaded fittings 61 and 62 are attached to these ports in order to connect to fuel line sections 13 and 13*a* described previously. A valving port 63 is formed by the body 51 and an annular raised seat 64 extends about port 63, and is presented upwardly.

A second chamber 65 is formed by the housing means, and in particular, by the cap 52 spaced above the lower chamber 58. A port 66 through a flange 52*a* of the cap communicates with chamber 65; and a threaded fitting 67 is received in port 66. That fitting is attached to receive the end of a duct 68, which also communicates with the manifold 18 to which supercharged air pressure is delivered.

A diaphragm assembly extends between upper and lower chambers 65 and 58 and is centrally movable relative thereto. That assembly, indicated generally at 70, includes a first diaphragm 71 having a first (lower) side 71*a* exposed to the first chamber 58. The assembly also includes a second diaphragm 72 having a first (upper) side 72*a* exposed to the second chamber 65. Side 71*a* faces downwardly and side 72*a* faces upwardly, whereby pressure levels in the chambers influence movement of the diaphragm assembly. For example, a decrease in manifold air pressure is sensed by diaphragm 72, and the diaphragm assembly thereby tends to move upwardly, allowing more fuel from the rail to pass through the flow control unit, as a result of upwardly movement of a stopper 79 away from the seat 64. The stopper is carried by the diaphragm assembly, as shown, and movable therewith. The stopper is at the lower side of diaphragm 71; and an adapter is carried by the diaphragm assembly at the upper side of diaphragm 71.

In this regard, and as referred to above, as the stopper moves away from the seat, more return fuel flow tends to pass through the unit 50, in-flowing from the rail back toward the tank 12, reducing the fuel pressure in the rail as is consistent with a reduction in manifold air pressure supplied by the supercharger. Furthermore, it is desired that the rate of change of liquid fuel pressure in the rail correspond to the rate of change of air pressure in the manifold, so that the amount of fuel injected into the cylinders will be such as to more closely maintain a desired fuel-air ratio supplied to the engine cylinders.

To enhance this rate of change control, control means is provided in association with the diaphragm assembly, to allow adjustment of the effective cross sectional area of the second diaphragm. This is important, for example, to allow adjustment of the control unit for use with different engine and supercharger installations, whereby each installation may be "tuned" via the described control means to provide for the desired smooth rate of change of fuel pressure in the rail with change of boost pressure in the manifold, as referred to above.

A preferred control means comprises a control plate adjacent the second (under) side of the second diaphragm, and associated structure extending peripherally about the plate, allowing plate movement with the second diaphragm along an axis 101 extending through the chambers, the area of the plate being selectable. See in this regard the thin, metallic plate 85 closely underlying the second diaphragm, and preferably adjacent that diaphragm, the plate having a circular periphery 85*a* closely spaced to a bore wall 86 formed by the much thicker plate 53 located between the diaphragms. Outer portions of the diaphragm receive support from plate 53.

Plate 53 is fixed, whereas the thin plate 85 moves up and down with the center portions of the diaphragm assembly, plate 85 moving in a sub-chamber 87 formed by plate 53. An adapter 80 projects upwardly into sub-chamber 87 and has a reduced flat protrusion 80*a* bearing against the underside of plate 85. Chamber 87 is vented at 87*a*.

Diaphragm 72 and plate 85 support the adapter in this position. The vertical thickness of chamber 87, in which plate 85 may move downwardly, allows for downward closure of the stopper against the seat, as is clear from the drawing.

Figure 5:
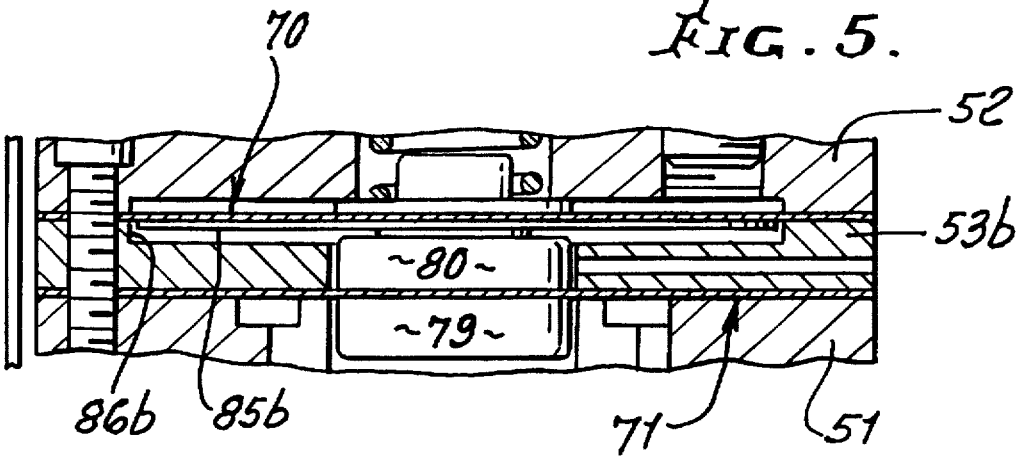
FIGS. 5–7 are fragmentary views showing several different size control means, such as plates, adjacent the second diaphragm in the flow control unit, and movable with that diaphragm to adjust the rate of change of fuel pressure level at the injector rail, with changes in boost pressure delivery by the engine-driven supercharger.
Figure 6:
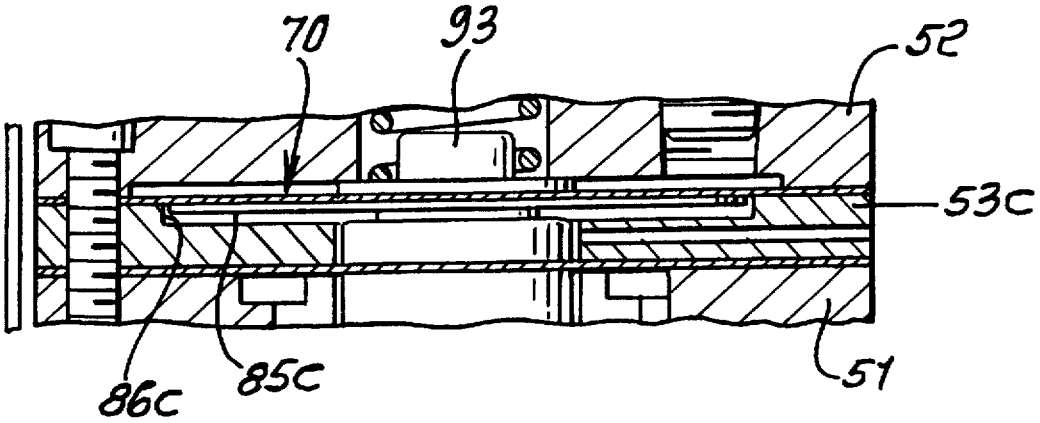
Figure 7:
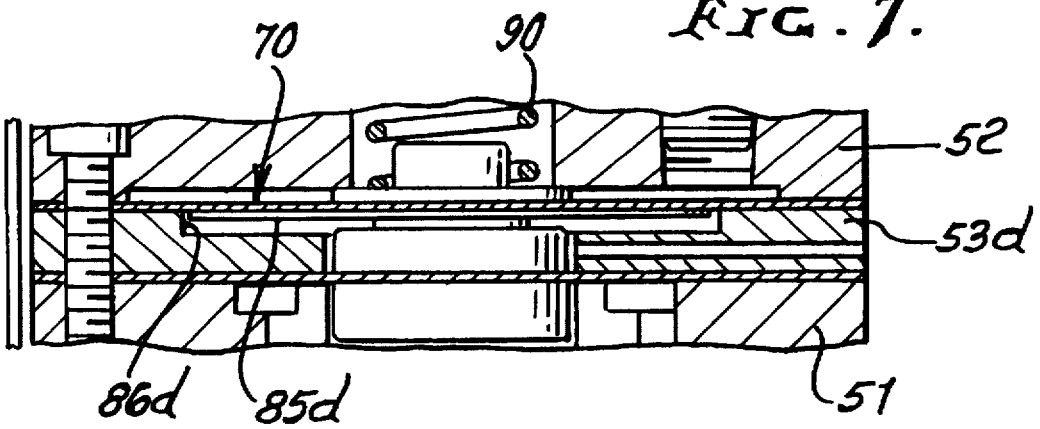

FIGS. 5–7 show control plates 85*b*, 85*c* and 85*d* (corresponding to plate 85) having different diameters, and therefore different sizes bearing against the underside of the upper diaphragm 70. In addition, the thicker plates 53*b*, 53*c* and 53*d* (corresponding to plate 53) shown in FIGS. 5–7 have different diameter bore walls 86*b*, 86*c* and 86*d* corresponding to the changing peripheral diameters of the associated thin plates 85*b*–85*d*, and closely spaced thereto. As a result, the supported annular under portion of the upper diaphragm varies, as shown in FIGS. 2 and 5–7; and the outer flex region of the upper diaphragm varies.

This selectability of variable diameter components associated with the upper diaphragm, leaving the lower diaphragm unchanged, results in the desired achievement of smooth rate of change of injection liquid fuel pressure at the rail, with corresponding rate of change of boost pressure in the air manifold. Note that the response of the upper diaphragm and the associated control means to changes in rail liquid fuel pressure communicated to the upper side of the upper diaphragm varies with the selection of the control components, as referred, and therefore may be "tuned" to the requirements of a given installation. The particular construction of the flow control unit 50 achieves these desired ends.

FIG. 2 also shows the provision of an adjustable tension spring 90 in the cap chamber 91 and exerting downward pressure on the diaphragm assembly, as via an upper plate 92. Plate 92 is located between the lower end of the spring and the upper surface of the upper diaphragm 70. Spring centering elements appear at 93 and 94 in chamber 91. Spring tension may be adjusted by rotation of a threaded adjuster 95 received in a threaded bore 96 in the cap. A nut 97 may be tightened against the top of the cap to hold the adjuster in selected position at desired spring tension exertion on the diaphragm assembly.

The diaphragm may consist of tough, durable, non-metallic material.

This invention has applicability for use with other types of compressed air delivery units, such as turbochargers, etc.

I claim:

1. The method of controlling liquid fuel pressure supplied to a supercharged internal combustion engine fueled injector or injectors, said method including:

a) providing housing means having fuel inlet and outlet ports, and a first chamber through which fuel flows in flowing to and through said ports, and through a valving port in said chamber, b) said housing means provided to define a second chamber spaced from said first chamber, c) providing a diaphragm assembly extending between said chambers and movable relative thereto, said assembly including a first diaphragm having a first side exposed to the first chamber, and a second diaphragm having a first side exposed to the second chamber, the second diaphragm having a second side, d) providing means for communicating engine manifold pressure to said second diaphragm, whereby a decrease in said manifold pressure results in a reduced liquid fuel pressure delivered to said injector or injectors, e) providing control means associated with said assembly to allow adjustment of the effective cross sectional area of the second diaphragm, f) said providing of the control means including providing a selected size thin plate, and locating said thin plate adjacent the second side of the second diaphragm, and providing an intermediate plate to extend peripherally about the thin plate, allowing thin plate movement with the second diaphragm along an axis extending through said chambers, g) providing adapter means extending between the diaphragms, whereby the diaphragms move together as a unit along said axis, h) said adapter means provided to centrally underlie the thin plate whereby force is transmitted centrally between the second diaphragm and the adapter means via the thin plate, the thin plate having a central portion sandwiched between the adapter means and the second diaphragm whereby thin plates of selected different overall area may be positioned between the adapter means and the second diaphragm.

2. The method of claim 1 including providing multiple sets of said thin plates and intermediate plates for extending peripherally about said respective thin plates, the thin plates having diameters that are different, any of said sets being selectable for use between said diaphragms to achieve smooth rate of change of fuel pressure in an injector rail as manifold air pressure changes.

3. In a flow control unit for controlling liquid fuel pressure supplied to a supercharged internal combustion engine fuel injector or injectors, the combination comprising a) housing means having fuel inlet and outlet ports, and a first chamber through which fuel flows in flowing to and through said ports, and through a valving port in said chamber, b) said housing means also defining a second chamber spaced from said first chamber, c) a diaphragm assembly extending between said chambers and movable relative thereto, said assembly including a first diaphragm having a first side exposed to the first chamber, and a second diaphragm having a first side exposed to the second chamber, the second diaphragm having a second side, d) means for communicating engine manifold pressure to said second diaphragm, whereby a decrease in said manifold pressure results in a reduced liquid fuel pressure delivered to said injector or injectors, e) and control means associated with said assembly to allow adjustment of the effective cross sectional area of the second diaphragm, f) said control means comprising a thin plate adjacent the second side of the second diaphragm, and an intermediate plate extending peripherally about the thin plate, allowing thin plate movement with the second diaphragm, along an axis extending through said chambers, g) there being adapter means extending between the diaphragms, whereby the diaphragms move together as a unit along said axis, h) said adapter means centrally underlying the thin plate whereby force is transmitted centrally between the second diaphragm and the adapter means via the thin plate, the thin plate having a central portion sandwiched between the adapter means and the second diaphragm whereby thin plates of selected different overall area may be positioned between the adapter means and the second diaphragm.

4. The combination of claim 3 including a stopper carried by said diaphragm assembly and movable toward and away from said valving port.

5. The combination of claim 3 including a supercharger fuel rail having associated injectors, and defining a fuel chamber connected in series with said housing fuel inlet port.

6. The combination of claim 5 including a line connected with said housing fuel outlet port to deliver fuel to a fuel supply tank associated with a supercharger.

7. The combination of claim 3 including a spring acting on said diaphragm assembly at said first side of the second diaphragm, there being a stopper carried by the diaphragm assembly urged in a direction toward said valving port by said spring.

8. The combination of claim 3 wherein said intermediate plate forms a bore having a bore wall of selected diameter, proximate which the periphery of said thin plate extends.

9. The combination of claim 8 wherein the second diaphragm has a narrow, annular flex region outwardly of said periphery of the thin plate.

10. The combination of claim 8 wherein said unit includes a body at one side of said support plate, and a cap at the opposite side of said support plate, and means holding said body, cap and support plate in fixed, assembled relation.

* * * * *